US005374512A

United States Patent [19]

Heki et al.

[11] Patent Number: 5,374,512

[45] Date of Patent: Dec. 20, 1994

[54] SILVER HALIDE PHOTOGRAPHIC EMULSION

[75] Inventors: Katsuhiko Heki; Yasuhiko Kawashima, both of Hino, Japan

[73] Assignee: Konica Corporation, Japan

[21] Appl. No.: 170,099

[22] Filed: Dec. 20, 1993

[30] Foreign Application Priority Data

Dec. 24, 1992 [JP] Japan ..... 4-344184

[51] Int. Cl.[5] ..... G03C 1/29

[52] U.S. Cl. ..... 430/574; 430/580; 430/581; 430/583; 430/584; 430/585

[58] Field of Search ..... 430/580, 574, 581, 583, 430/584, 585, 546

[56] References Cited

FOREIGN PATENT DOCUMENTS 1310750 3/1973 United Kingdom .

*Primary Examiner*—Thorl Chea

*Attorney, Agent, or Firm*—Jordan B. Bierman

[57] ABSTRACT

A silver halide photographic emulsion comprising a substantially water-insoluble, spectral sensitizing dye and a styryl compound represented by the following formula, wherein the sensitizing dye is dispersed in an aqueous solution substantially free from an organic solvent and the thus-dispersed dye is introduced into the silver halide emulsion.

4 Claims, 1 Drawing Sheet

SILVER HALIDE PHOTOGRAPHIC EMULSION

FIELD OF THE INVENTION

This invention relates to a silver halide photographic emulsion, and more particularly to a silver halide photographic emulsion having a high sensitivity and promising a superior latent image stability.

BACKGROUND OF THE INVENTION

Light-sensitive silver halide photographic materials (hereinafter "light-sensitive material(s)") must have stability with time as one of important properties. In particular, the stability required after they has been exposed and until they are photographically processed, i.e., latent image stability, is an important factor.

Latent images formed as a result of exposure of silver halides are unstable, and may fade or intensify with time because of heat or the like, resulting in a decrease or increase in sensitivity in regard to photographic performance.

This latent image stability is greatly affected by the manner by which silver halides are produced, structured, surface-treated, chemically sensitized or spectrally sensitized, the properties of binders such as gelatin, the types of hardening agents, the pH of coating solutions, the concentration of silver ions and so forth.

In order to improve latent image stability, various methods have been proposed. For example, Japanese Patent Publication Open to Public Inspection (hereinafter referred to as Japanese Patent O.P.I. Publication) No. 291250/1989 discloses use of benzothiazolium; Japanese Patent O.P.I. Publication No. 17431/1983, use of pyrogallol derivatives; and Japanese Patent O.P.I. Publication No. 152235/1983, use of tetrazaindenes. Japanese Patent O.P.I. Publication No. 257947 also discloses controlling tabular grains and their surface pH.

Employment of these techniques, however, can not achieve a satisfactory improvement in latent image stability or may be accompanied by a lowering of sensitivity or an increase in fog, and hence it has been sought to make an advance of more improved techniques.

SUMMARY OF THE INVENTION

Accordingly, an object of the present invention is to provide a silver halide emulsion having a high sensitivity, a low fog and a superior latent image stability.

The present inventors made extensive studies to make an advance of silver halide emulsions satisfying the demand stated above. As a result, they have discovered that the object of the present invention can be achieved by the use of a silver halide photographic emulsion containing i) a dispersion prepared by dispersing in water a substantially water-insoluble spectral sensitizing dye in the state the water contains substantially no organic solvent and ii) a compound represented by the following Formula I.

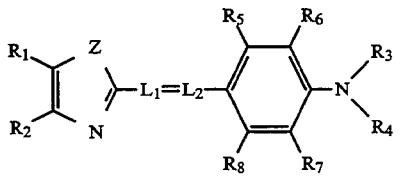

Formula I wherein $R_1$, $R_2$, $R_3$ and $R_4$ each represent a hydrogen atom, an alkyl group, an alkenyl group, an alkynyl group, an aryl group or a heterocyclic group; $R_5$, $R_6$, $R_7$ and $R_8$ each represent a substituent; $L_1$ and $L_2$ each represent a methine group; Z represents an oxygen atom, a sulfur atom, a selenium atom, a tellurium atom, a $—C(R_9)(R_{10})—$ group or an $—N(R_9)—$ group, where $R_9$ and $R_{10}$ each represent a hydrogen atom, an alkyl group, an alkenyl group, an alkynyl group, an aryl group or a heterocyclic group; and $R_1$ and $R_2$, $R_3$ and $R_4$, and $R_9$ and $R_{10}$ may each combine to form a ring.

DETAILED DESCRIPTION OF THE INVENTION

The present invention will be described below in detail.

In the present invention, the organic solvent refers to a solvent containing a carbon atom and is liquid at room temperature. Solvents hitherto used particularly for dispersing spectral sensitizing dyes are exemplified by alcohols, ketones, nitriles and alkoxyalcohols. They may specifically include methanol, ethanol, propyl alcohol, iso-propyl alcohol, ethylene glycol, propylene glycol, 1,3-propanediol, acetone, acetonitrile, 2-methoxyethanol and 2-ethoxyethanol.

In the present invention, any of these organic solvents are substantially not contained.

In the present invention, what is meant by ". . . contains substantially no organic solvent" is that the organic solvent described above is in a content of not more than 10% by weight, preferably not more than 5% by weight, and particularly preferably not more than 3% by weight, based on the weight of water.

To disperse the organic solvent in water in the state the water contains substantially no organic solvent, various dispersion methods can be effectively used. Stated specifically, a high-speed stirrer, a ball mill, a sand mill, a colloid mill, an attritor, an ultrasonic dispersion machine and so forth may be used. In the present invention, a high-speed stirrer is preferred.

Figure 1:
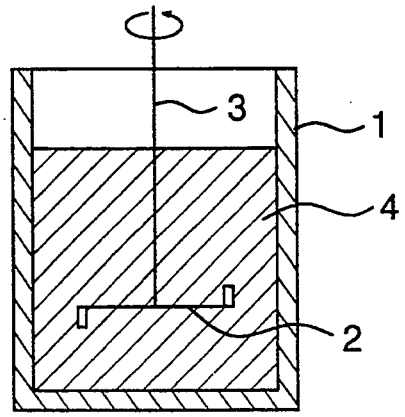
FIG. 1A schematically illustrates a high-speed stirring dispersion machine.
FIG. 1B is a perspective view of an impeller.
Figure 1:
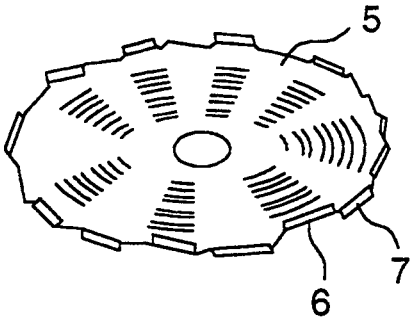

A high-speed stirring dispersion machine can be exemplified by a dispersion machine comprised of, as shown in FIG. 1A, a tank 1, a dissolver blade 2 and a vertical shaft 3. FIG. 1B illustrates an impeller that constitutes the dissolver blade 2.

The high-speed stirring dispersion machine may also be of the type having a dissolver comprising a vertical shaft to which a plurality of impellers are fitted or a multi-shaft dissolver provided with a plurality of vertical shafts. Besides the one comprised of the dissolver alone, a high-speed stirring dispersion machine having an anchor blade is more preferred. To specifically describe an example of operation, water is put in a temperature-controllable tank and thereafter a powder of the spectral sensitizing dye is added in a given quantity, followed by stirring using the high-speed stirrer for a given time under temperature control, and then pulverization and dispersion. There are no particular limitations on the pH and temperature when the spectral sensitizing dye is mechanically dispersed. If, however, the dispersion is carried out at a low temperature for a long time, no desired particle size can be achieved, or if it is carried out at a high temperature, reagglomeration or decomposition may occur to make it impossible to obtain the desired photographic performance. Also, if the temperature is raised, the viscosity of a solvent system may decrease to cause a great lowering of solid-body pulverization and dispersion efficiency. On account of these problems, the dispersion may preferably be carried out at a temperature of from 15° to 50° C. With regard to the revolution number of the stirring when the dispersion is carried out, stirring at a low revolution number may take a long time for achieving the desired particle size and stirring at an excessively high revolution number may cause inclusion of bubbles to make dispersion efficiency lower. Hence, the stirring may preferably be carried out at from 1,000 to 6,000 r.p.m.

The dispersion referred to in the present invention refers to a suspension of the spectral sensitizing dye. A suspension containing the spectral sensitizing dye in a weight ratio of from 0.2 to 5.0% may preferably be used.

The spectral sensitizing dye dispersion prepared according to the present invention may be directly added to the silver halide emulsion, or may be added after its appropriate dilution. When diluted, water is used as a diluent.

When the spectral sensitizing dye is dispersed in water, a surface active agent may be used. The surface active agent herein referred to includes anionic surface active agents, cationic surface active agents, nonionic surface active agent and amphoteric surface active agents.

When the spectral sensitizing dye is dispersed in water, any of these surface active agents may be used, but may preferably be not used.

In the present invention, the substantially water-insoluble spectral sensitizing dye refers to a spectral sensitizing dye whose solubility in water is not more than $8\times10^{-2}$ mol/lit., preferably not more than $4\times10^{-2}$ mol/lit., and more preferably not more than $2\times10^{-2}$ mol/lit.

The solubility of the spectral sensitizing dye in water as herein referred to is measured by the following method.

In a 50 cc Erlenmeyer flask, 30 cc of water is put, and a dye is added thereto in a quantity large enough for the dye not to completely dissolve under visual observation, followed by stirring using a magnetic stirrer for 10 minutes while keeping the mixture at 27° C. in a thermostatic chamber. The resulting suspension is filtered using filter paper No. 2, available from Toyo K.K., and the filtrate is further filtered using a disposable filter available from Toso Go., Ltd. The resulting filtrate is appropriately diluted and its light absorbance is measured by means of a spectrophotometer U3410, manufactured by Hitachi Ltd. From measurements, the solubility (mol/liter) is calculated according to the Lambert-Beer law:

$$D=\epsilon lc$$

wherein D: absorbance, $\epsilon$: coefficient of molecular absorbance, l: absorbance measuring cell length, and c: concentration (mol/liter).

The spectral sensitizing dye used in the present invention may include cyanine dyes, merocyanine dyes and styryl dyes. In particular, cyanine dyes are preferred.

A preferable cyanine dye is represented by the following Formula II.

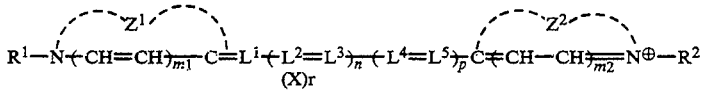

Formula II

In the formula, $Z^1$ and $Z^2$ each represent a group of atoms necessary to form a nitrogen-containing heterocyclic ring of 5 or 6 members, $L^1$, $L^2$, $L^3$, $L^4$ and $L^5$ each represent a methine group and $R^1$ and $R^2$ each independently represent a substituted or unsubstituted alkyl group.

X represents a charge equilibrating counter ion, and r represents a value that neutralizes the net charge or the dye moiety. Letter symbols $m_1$ and $m_2$ are each an integer of 0 or 1, and n and p are each an integer of 0 to 2.

The above spectral sensitizing dye is the spectral sensitizing dye as disclosed in Japanese Patent O.P.I. Publication No. 219232/1991 as a spectral sensitizing dye of Formula I. Its substituents are detailed at page 3, right lower column to page 7, right upper column of the publication. Its exemplary compounds are also listed at page 7, left lower column to page 14, right lower column, as compounds I-1 to I-155.

The sensitizing dye is contained in an amount of $1\times10^{-6}$ to $1\times10^{-2}$ mol, and preferably $5\times10^{-6}$ to $1\times10^{-3}$ mol, per mol of silver halide.

The compound represented by Formula I will be described below.

In Formula I, the alkyl group represented by $R_1$, $R_2$, $R_3$ or $R_4$ may include groups as exemplified by methyl, ethyl, propyl, i-propyl, butyl, t-butyl, pentyl, cyclopentyl, hexyl, cyclohexyl, octyl and dodecyl. These alkyl groups may also be substituted with a halogen atom as exemplified by chlorine, bromine or fluorine, an alkoxyl group as exemplified by methoxy, ethoxy, 1,1-dimethylethoxy, hexyloxy or dodecyloxy, an aryloxy group as exemplified by phenoxy or naphthyloxy, an aryl group as exemplified by phenyl or naphthyl, an alkoxycarbonyl group as exemplified by methoxycarbonyl, ethoxycarbonyl, butoxycarbonyl or 2-ethylhexylcarbonyl, an aryloxycarbonyl group as exemplified by phenoxycarbonyl or naphthyloxycarbonyl, an alkenyl group as exemplified by vinyl or allyl, a heterocyclic group as exemplified by 2-pyridyl, 3-pyridyl, 4-pyridyl, morpholyl, piperidyl, piperazyl, pyrimidyl, pyrazolyl or furyl, an alkynyl group as exemplified by propagyl, an amino group as exemplified by amino, N,N-dimethylamino or anilino, a hydroxyl group, a cyano group, a sulfo group, a carboxyl group, or a sulfonamido group as exemplified by methylsulfonylamino, ethylsulfonylamino, butylsulfonylamino, octylsulfonylamino or phenylsulfonylamino.

The alkenyl group represented by $R_1$, $R_2$, $R_3$ or $R_4$ may include groups as exemplified by vinyl and allyl.

The alkynyl group represented by $R_1$, $R_2$, $R_3$ or $R_4$ may include groups as exemplified by propagyl.

The aryl group represented by $R_1$, $R_2$, $R_3$ or $R_4$ may include groups as exemplified by phenyl and naphthyl.

The heterocyclic group represented by $R_1$, $R_2$, $R_3$ or $R_4$ may include groups as exemplified by a pyridyl group such as 2-pyridyl, 3-pyridyl or 4-pyridyl, a thiazolyl group, an oxazolyl group, an imidazolyl group, a furyl group, a thienyl group, a pyrolyl group, a pyrazinyl group, a pyrimidiny group, a pyridazinyl group, a selenasolyl group, a sulfolanyl, a piperidinyl group, a piperazolyl group and a tetrazolyl group.

All the above alkenyl group, alkynyl group, aryl group and heterocyclic group may be substituted with the same group as the group shown as the alkyl group represented by $R_1$, $R_2$, $R_3$ or $R_4$ and the substituent of the alkyl group.

The substituent represented by $R_5$, $R_6$, $R_7$ or $R_8$ includes an alkyl group, an alkenyl group, an alkynyl group, an aryl group, a heterocyclic group, a halogen atom, an alkoxyl group, an aryloxy group, an alkoxycarbonyl group, an aryloxycarbonyl group, a sulfonamido group, a sulfamoyl group, a ureido group, an acyl group, a carbamoyl group, an amido group, a sulfonyl group, an amino group, a cyano group, a nitro group, a carboxyl group, a hydroxyl group and a hydrogen atom. These groups may be substituted with the same group as the group shown as the alkyl group represented by $R_1$, $R_2$, $R_3$ or $R_4$ and the substituent of the alkyl group.

The ring that can be formed by $R_1$ or $R_2$ may include rings as exemplified by benzene, naphthalene, thiophene, pyridine, furan, pyrimidine, cyclohexene, pyran, pyrol, pyrazine and indol.

The ring that can be formed by $R_3$ or $R_4$ may include rings as exemplified by piperidine, pyrrolidine, morpholine, pyrol, pyrazole and piperazine.

The ring that can be formed by $R_9$ or $R_{10}$ may include rings as exemplified by cyclopentane and cyclohexane.

The foregoing rings may be substituted with the same group as the group shown as the alkyl group represented by $R_1$, $R_2$, $R_3$ or $R_4$ and the substituent of the alkyl group.

The methine group represented by $L_1$ or $L_2$ may have a substituent. Such a substituent may include, for example, an alkyl group, an aryl group, a halogen atom, an alkoxyl group, an aryloxy group, an alkoxycarbonyl group and an aryloxycarbonyl group. These groups may be substituted with the same group as the group shown as the alkyl group represented by $R_1$, $R_2$, $R_3$ or $R_4$ and the substituent of the alkyl group.

Examples of the compound represented by Formula I used in the present invention (hereinafter "the compound of the present invention") are shown below, by which, however, the present invention is by no means limited.

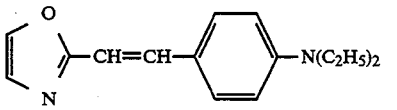
I-1

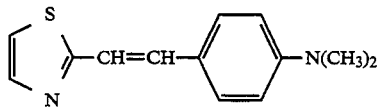
I-2

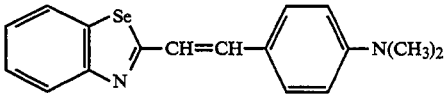
I-3

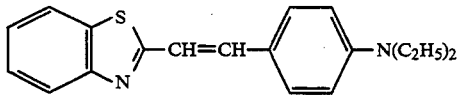
I-4

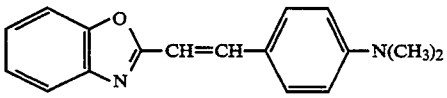
I-5

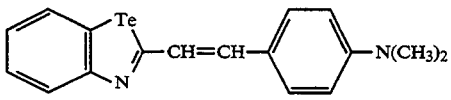
I-6

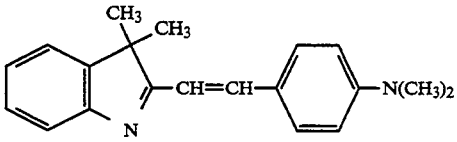
I-7

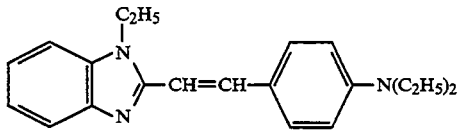
I-8

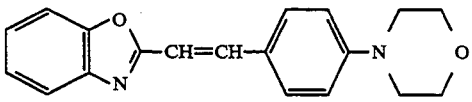
I-9

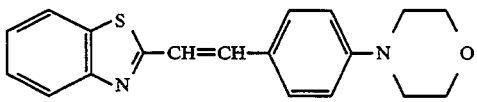
I-10

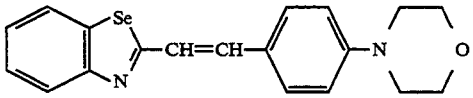
I-11

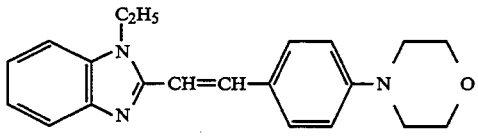
I-12

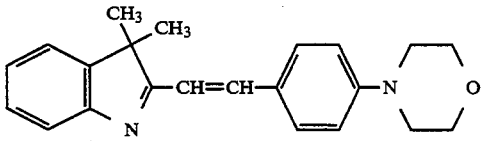
I-13

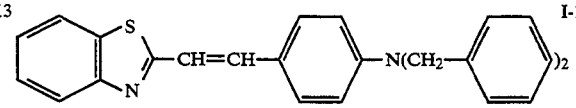
I-14

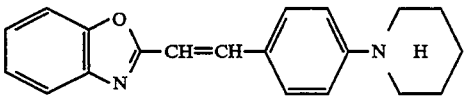
I-15

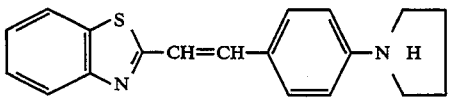
I-16

-continued
I-17
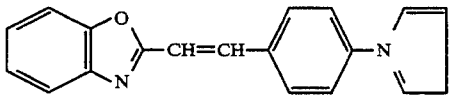
I-18
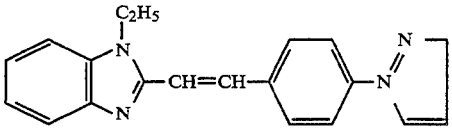
I-19
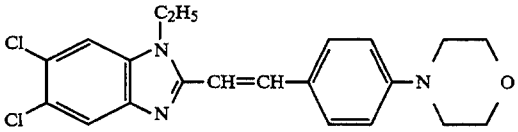
I-20
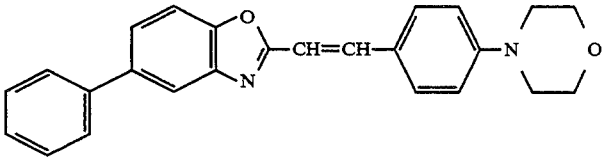
I-21
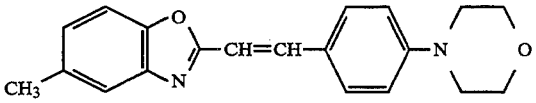
I-22
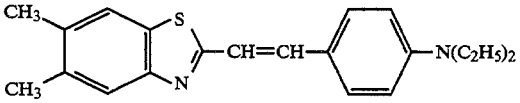
I-23
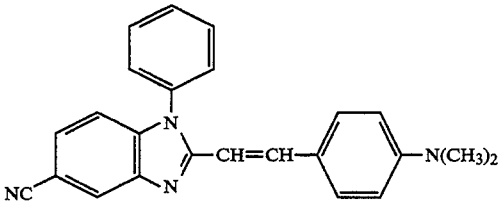
I-24
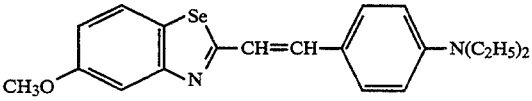
I-25
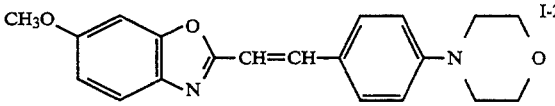
I-26
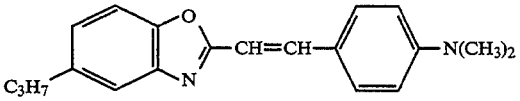
I-27
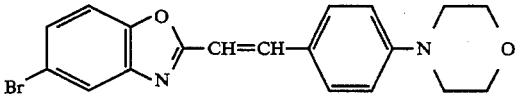
I-28
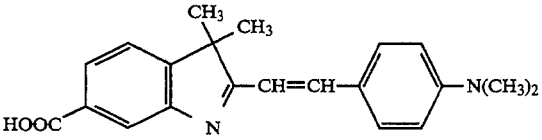
I-29
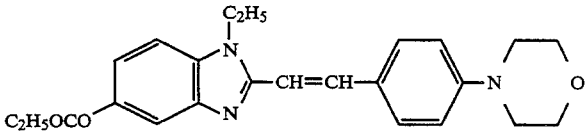
I-30
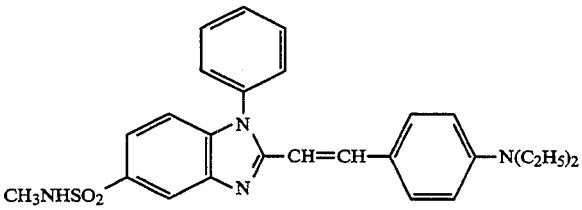
I-31
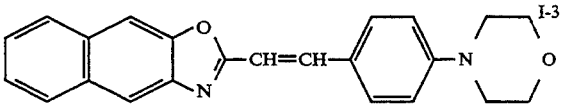
I-32
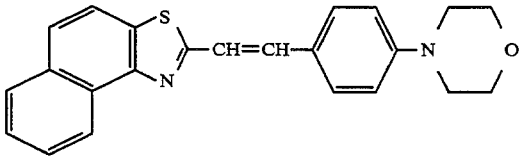

-continued
I-33
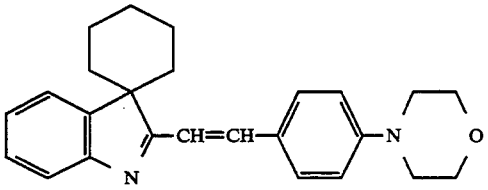
I-34
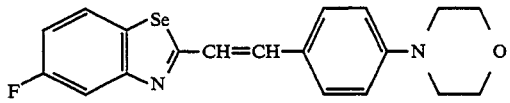
I-35
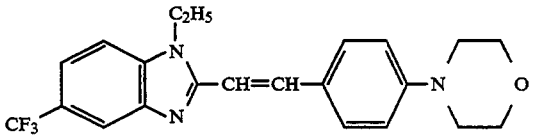
I-36
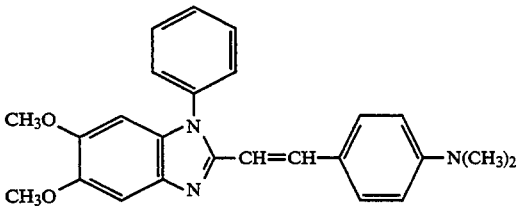
I-37
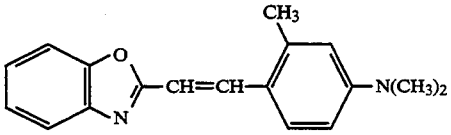
I-38
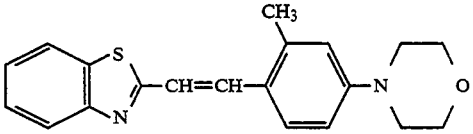
I-39
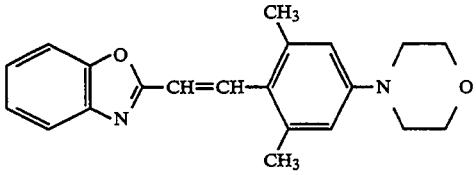
I-40
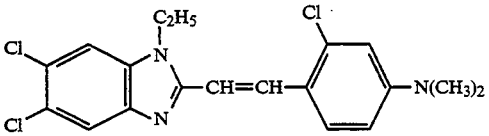
I-41
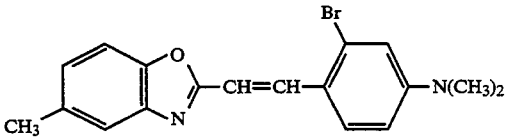
I-42
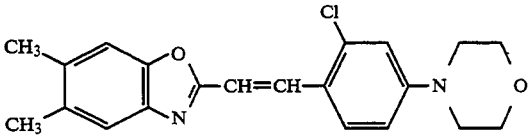
I-43
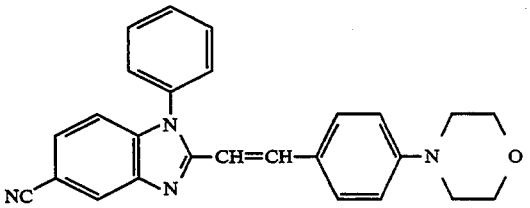
I-44
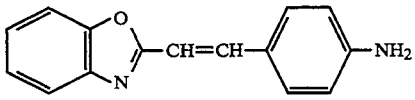
I-45
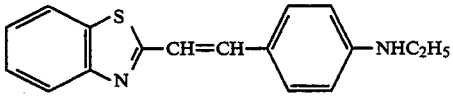
I-46
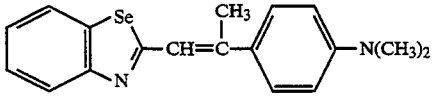
I-47
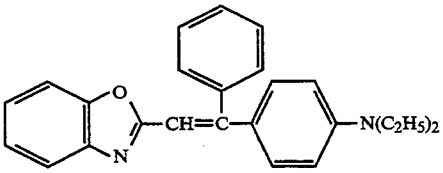
I-48
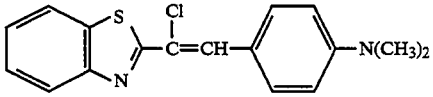
I-49
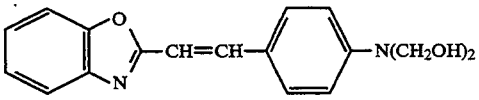
I-50
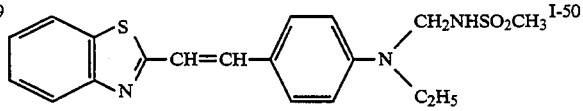

-continued

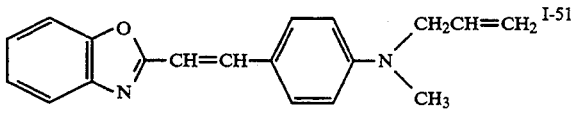
I-51

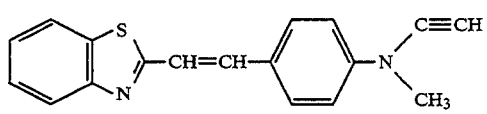
I-52

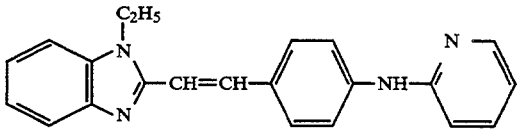
I-53

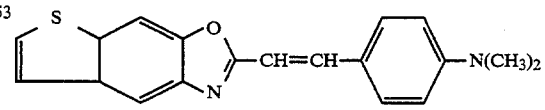
I-54

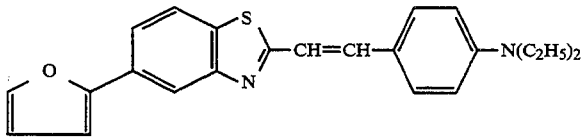
I-55

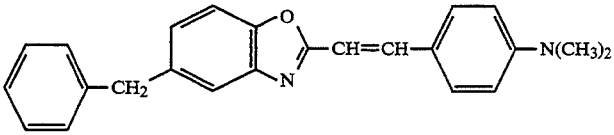
I-56

Synthesis of the compound of the present invention will be shown below by taking a specific compound as an example. Other compounds can also be synthesized by similar methods.

SYNTHESIS EXAMPLE 1

Synthesis of Exemplary Compound 4

To 14.9 g of 2-methylbenzothriazole, 17.7 g of p-diethylaminobenzaldehyde, 6 g of sodium hydride (mineral oil: 60%) and 60 cc of dimethylfromamide were added to carry out faction at room temperature for 30 minutes. The reaction mixture was poured into water to filtrate deposited solid matter. The solid matter was dried and thereafter recrystallized with methanol to obtain the end product. Yield: 19.4 g (63%).

The compound of the present invention may preferably be added in an amount of from $2\times10^{-7}$ to $1\times10^{-2}$ mol, and more preferably from $2\times10^{-7}$ to $5\times10^{-3}$ mol, per mol of silver halide.

The compound of the present invention may be added to the silver halide emulsion by any methods well known in the present industrial field. For example, the compound may be directly dispersed in the emulsion. Alternatively, it may be dissolved in a water-soluble solvent such as pyridine, methanol, ethanol, methyl cellosolve, acetone, fluorinated alcohol, dimethylformamide or a mixture of any of these, or diluted with or dissolved in water so that it can be added to the emulsion in the form of a solution. In the course of dissolution, ultrasonic vibration may also be used.

It is also possible to use a method in which, in the manner as disclosed in U.S. Pat. No. 3,469,987, the compound of the present invention is dissolved in a volatile organic solvent, the solution obtained is dispersed in a hydrophilic colloid, and the resulting dispersion is added to the emulsion, or a method in which, in the manner as disclosed in Japanese Patent Examined Publication No. 24185/1971, the water-insoluble dye is dispersed in a water-soluble solvent without its dissolution, and the resulting dispersion is added to the emulsion.

The compound of the present invention may also be added to the emulsion in the form of a dispersion prepared by acid fusion dispersion.

In the present invention, the substantially water-insoluble spectral sensitizing dye dispersion prepared by dispersing in water in the state the water contains substantially no organic solvent may preferably be added in the course of from the formation of silver halide grains up to the completion of chemical sensitization.

The compound represented by Formula I may also preferably be added in the course of from the formation of silver halide grains up to the completion of chemical sensitization.

The substantially water-insoluble spectral sensitizing dye dispersion prepared by dispersing in water in the state the water contains substantially no organic solvent and the compound represented by Formula I may be added to the silver halide emulsion either simultaneously or separately.

In the present invention, the silver halide emulsion as disclosed in Research Disclosure No. 308119 (hereinafter "RD308119") can be used. Items described and paragraphs thereof are shown in the following table.

| Items | Page of RD308119 |
|---|---|
| Iodide composition | 993 Par. I-A |
| Preparation method | 993 Par. I-A and 994 Par. E |
| Crystal habit: | |
| Regular crystal | 993 Par. I-A |
| Twinned crystal | 993 Par. I-A |
| Epitaxial growth | 993 Par. I-A |
| Halide composition: | |
| Uniform | 993 Par. I-B |
| Not uniform | 993 Par. I-B |
| Halide conversion | 994 Par. I-C |
| Halide substitution | 994 Par. I-C |
| Metal occlusion | 994 Par. I-D |
| Monodispersion | 995 Par. I-F |
| Addition of solvent | 995 Par. I-F |
| Latent image forming position: | |
| Surface | 995 Par. I-G |
| Interior | 995 Par. I-G |
| Light-sensitive material: | |
| Negative | 995 Par. I-H |

-continued

| Items | Page of RD308119 |
|---|---|
| Positive (containing internally fogged grains) | 995 Par. I-H |
| Use of emulsion by mixture | 995 Par. I-J |
| Desalting | 995 Par. II-A |

In the present invention, silver halide emulsions having been subjected to physical ripening, chemical ripening and spectral sensitization are used. Additives used in such steps are described in Research Disclosures No. 17643, No. 18716 and No. 308119 (hereinafter "RD17643", "RD18716" and "RD308119", respectively).

Items described and paragraphs thereof are shown in the following table.

| Items | Page of RD308119, RD17643, RD18716 | | | |
|---|---|---|---|---|
| Chemical sensitizer | 996 | Par. III-A | 23 | 648 |
| Spectral sensitizer | 996 | Par. IV-A-A, B, C, D, E, H, I, J | 23-24 | 648-649 |
| Supersensitizer | 996 | Par. IV-A-E, J | 23-24 | 648-649 |
| Antifoggant | 998 | Par. VI | 24-25 | 649 |
| Stabilizer | 998 | Par. VI | 24-25 | 649 |

Photographic additives are also described in the above Research Disclosures. Items described and paragraphs thereof are shown in the following table.

| Items | Page of RD308119, RD17643, RD18716 | | | |
|---|---|---|---|---|
| Color contamination preventive agent | 1002 | Par. VII-I | 25 | 650 |
| Color image stabilizer | 1001 | Par. VII-J | 25 | |
| Brightening agent | 998 | V | 24 | |
| Ultraviolet absorbent | 1003 | Par. VIIIC XIIIC | 25-26 | |
| Light absorbing agent | 1003 | Par. VIII | 25-26 | |
| Light scattering agent | 1003 | Par. VIII | | |
| Filter dye | 1003 | Par. VIII | 25-26 | |
| Binder | 1003 | Par. IX | 26 | 651 |
| Antistatic agent | 1006 | Par. XIII | 27 | 650 |
| Hardening agent | 1004 | Par. X | 26 | 651 |
| Plasticizer | 1006 | Par. XII | 27 | 650 |
| Lubricant | 1006 | Par. XII | 27 | 650 |
| Surfactant, coating aid | 1005 | Par. XI | 26-27 | 650 |
| Matting agent | 1007 | Par. VI | | |
| Developing agent (contained in light-sensitive materials) | 1011 | Par. XX-B | | |

Various couplers can be used in the present invention. Examples thereof are described in the above Research Disclosures. Related items described and paragraphs thereof are shown in the following table.

| Items | Page of RD308119, RD17643, RD18716 | | |
|---|---|---|---|
| Yellow coupler | 1001 | Par. VII-D | Par. VII-C-G |
| Magenta coupler | 1001 | Par. VII-D | Par. VII-C-G |
| Cyan coupler | 1001 | Par. VII-D | Par. VII-C-G |
| Colored coupler | 1002 | Par. VII-G | Par. VII-G |
| DIR coupler | 1001 | Par. VII-F | Par. VII-F |
| BAR coupler | 1002 | Par. VII-F | |
| Other useful residual group releasing coupler | 1001 | Par. VII-F | |
| Alkali-soluble coupler | 1001 | Par. VII-E | |

-continued

The additives used in the present invention can be added by the dispersion method as described in RD308119, Paragraph XIV.

In the present invention, the supports as described in the aforesaid RD17643, page 28, RD18716, pages 647 to 648 and RD308119, Paragraph XIX can be used.

The light-sensitive material used in the present invention may also be provided with the auxiliary layers such as filter layers and intermediate layers as described in RD308119, Paragraph VII-K.

The light-sensitive material used in the present invention may be comprised of various layers of conventional layer order, inverse layer order or unit structure as described in the aforesaid RD308119, Paragraph VII-K.

The present invention can be applied to various color light-sensitive materials as typified by color negative films for motion pictures, color reversal films for slides or television, and color positive films.

Any of these color light-sensitive materials may preferably have a total layer thickness of 24 μm or less, more preferably 20 μm or less, and still more preferably 18 μm or less, in respect of the whole hydrophilic colloid layers on the side having emulsion layers. It may also preferably have a layer swelling rate $T_{\frac{1}{2}}$ of 30 seconds or less, and more preferably 20 seconds or less. The layer thickness is meant to be a layer thickness measured in a moisture controlled environment of 25° C. and 55%RH (relative humidity) for 2 hours. The layer swelling rate $T_{\frac{1}{2}}$ can be measured by any methods known in the present technical field.

The layer swelling rate $T_{\frac{1}{2}}$ can be adjusted by adding a hardening agent to gelatin serving as a binder, or by changing conditions with time after coating. As for the degree of swelling, it may preferably be in the range of from 150 to 400%. The degree of swelling can be calculated from a maximum swelled layer thickness measured under the conditions stated above and according to the expression: (Maximum swelled layer thickness—Layer thickness)/Layer thickness.

The color light-sensitive material can be photographically processed by usual methods described in the above RD17643, pages 28-29, and RD18716, page 615, left column to right column.

When the color light-sensitive material is used in the form of a roll, it is preferable to take the form that the light-sensitive material is held in a cartridge. A most commonly available cartridge is a 135 format film magazine. Besides, the cartridges as proposed in the following patents may be used.

Japanese Utility Model O.P.I. Publications No. 67329/1983 and No. 181035/1983, U.S. Pat. No. 4,221,479, Japanese Patent O.P.I. Publications No. 231045/1989 and No. 199451/1990, and U.S. Pat. Nos. 4,846,418, 4,848,693 and 4,832,275.

The present invention can also be applied to "Small-sized photographic film magazines" (Toshihiko Yagi et al) filed Jan. 31, 1992.

The light-sensitive material of the present invention can be photographically processed by usual methods described in the above RD17643, pages 28-29, RD18716, page 615, and RD308119, paragraph XIX.

EXAMPLES

The present invention will be specifically described below by giving Examples. Working embodiments of the present invention are by no means limited to these.

In the following Examples, the amount of each additive is indicated as gram number per 1 $m^2$. The amounts of silver halides and colloidal silver are in terms of silver weight. Those of spectral sensitizing dyes are each indicated as molar number per mol of silver.

EXAMPLE 1

Preparation of twinned crystal seed emulsion T-1

An emulsion comprising grains having parallel double twin planes was prepared in the following way.

Solution A

| | |
|---|---|
| Ossein gelatin | 80.0 g |
| Potassium bromide | 47.4 g |
| Sodium polyisopropylene-polyethyleneoxy-disuccinate (10% methanol solution) | 0.48 cc |
| Using water, made up to | 8,000.0 cc |
| Solution B: | |
| Silver nitrate | 1,200.0 g |
| Using water, made up to | 1,600.0 cc |
| Solution C: | |
| Ossein gelatin | 32.2 g |
| Potassium bromide | 790.0 g |
| Potassium iodide | 70.34 g |
| Using water, made up to | 1,600.0 cc |
| Solution D: | |
| Ammonium water | 470.0 cc |

To solution A vigorously stirred at 40° C., solutions B and C were added by double jet precipitation over a period of 7.7 minutes to carry out formation of nuclei. In this course, the pBr was maintained at 1.60.

Thereafter, the temperature was dropped to 30° C. over a period of 30 minutes. Solution D was further added in 1 minute, and subsequently ripening was carried out for 5 minutes. At the time of the ripening, potassium bromide was in a concentration of 0.03 mol/liter, and ammonia, in a concentration of 0.66 mol/liter.

After the ripening was completed, the pH was adjusted to 6.0, followed by desalinization according to a conventional method. The resulting seed emulsion grains were observed on an electron microscope to ascertain that they were hexagonal tabular grains having double twin planes parallel to each other.

This seed emulsion grains had an average grain size (diameter) of 0.217 μm, and their parallel double twin planes were in a percentage of 75% in number ratio with respect to the whole particles.

Preparation of Emulsion EM-1 of the Present Invention

Using seven kinds of solutions shown below, octahedral twinned crystal monodisperse emulsion EM-1 having parallel double twin planes according to the present invention was prepared.

| | |
|---|---|
| - Solution A - | |
| Ossein gelatin | 61.0 g |
| Distilled water | 1,963.0 cc |
| Sodium polyisopropylene-polyethyleneoxy-disuccinate (10% methanol solution) | 2.5 cc |
| Seed emulsion T-1 | 0.345 mol |
| Aqueous 28 wt. % ammonia solution | 308.0 cc |
| Aqueous 56 wt. % acetic acid solution | 358.0 cc |
| Methanol solution containing 0.001 mol of iodide | 33.7 cc |

-continued

| | |
|---|---|
| Using distilled water, made up to | 3,500.0 cc |
| - Solution B - | |
| Aqueous 3.5 N ammoniacal silver nitrate solution (adjusted to pH 9.0 using ammonium nitrate) | |
| - Solution C - | |
| Aqueous 3.5 N potassium bromide solution | |
| - Solution D - | |
| Fine-grain emulsion* comprised of 3 wt. % gelatin and silver iodide grains (average grain size: 0.05 μm) | 1.40 mol |

* prepared in the following way.

To 5,000 cc of a 0.6 wt. % gelatin solution containing 0.06 mol of potassium iodide, 2,000 cc of aqueous solutions each containing 7.06 mol of silver nitrate and 7.06 mol of potassium iodide were added over a period of 10 minutes. The pH in the course of the formation of fine grains was controlled to be 2.0 using nitric acid, and the temperature, 40° C. After the formation of grains, the pH was adjusted to 6.0 using an aqueous sodium carbonate solution.

| | |
|---|---|
| - Solution E - | |
| Fine-grain emulsion comprised of silver iodobromide grains containing 2 mol % of silver iodide (average grain size: 0.04 μm), prepared in the same manner as the silver iodide fine-grain emulsion described in solution D | 3.68 mol |

In the course of the formation of grains, the temperature was controlled to be 30° C.

| |
|---|
| In the course of the formation of grains, the temperature was controlled to be 30° C. |
| - Solution F - |
| Aqueous 1.75 N potassium bromide solution |
| - Solution G - |
| Aqueous 56 wt. % acetic acid solution |

To solution A kept at 70° C. in a reaction vessel, solutions B, C and D were added by double jet precipitation over a period of 128 minutes. Thereafter, solution E was subsequently added alone at a constant rate over a period of 7 minutes to make the seed crystals grow to have a size of 0.806 μm.

Here, the solutions B and C were added by accelerated flow rate precipitation, the flow rate being so changed with respect to time as to accord with the critical growth rate, and were added at a suitable rate of addition so as not to become polydisperse because of small grains other than the growing seed crystals and because of Ostwald ripening. Solution D, i.e., the silver iodide fine-grain emulsion was fed while its rate ratio (molar ratio) to the aqueous ammoniacal silver nitrate solution was changed with respect to grain size (addition time) as shown in Table 1. Thus, a core/shell silver halide emulsion having a multiple structure was prepared.

Using solutions F and G, the pAg and pH in the course of crystal growth were controlled as shown in Table 1. The pAg and pH were measured by a conventional method, using a silver sulfide electrode and a glass electrode.

After the formation of grains, desalinization was carried out by the method as disclosed in Japanese Patent Application No. 41314/1991, followed by addition of gelatin to carry out redispersion, and the pH and pAg were adjusted to 5.80 and 8.06, respectively, at 40° C. From a scanning electron microscope photograph of the emulsion grains, the emulsion were ascertained to be an octahedral twinned crystal monodisperse emulsion having an average grain size of 0.806 μm and a breadth of distribution of 12.0%.

TABLE 1

| Addition time (min) | Grains size (μm) | Flow rate ratio of Solution D | pH | pAg |
|---|---|---|---|---|
| Intermediate layer: | | | | |
| 0.0 | 0.217 | 6.0 | 7.2 | 7.8 |
| 26.2 | 0.345 | 20.1 | 7.2 | 7.8 |
| 40.86 | 0.394 | 29.5 | 7.2 | 7.8 |
| Core: | | | | |
| 41.57 | 0.397 | 30.0 | 7.2 | 7.8 |
| 54.11 | 0.434 | 30.0 | 7.2 | 7.8 |
| 64.89 | 0.466 | 30.0 | 7.2 | 7.8 |
| Shell: | | | | |
| 67.98 | 0.476 | 28.9 | 7.2 | 7.8 |
| 96.53 | 0.593 | 7.7 | 7.2 | 7.8 |
| 96.53 | 0.593 | 0.0 | 6.5 | 9.4 |
| 126.33 | 0.730 | 0.0 | 6.5 | 9.7 |
| 128.00 | 0.745 | 0.0 | 6.5 | 9.7 |

EM-1 was chemically sensitized by adding sodium thiosulfate, chloroauric acid and ammonium thiocyanate, and then divided into 15 emulsions, to which the following spectral sensitizing dye 1 and the compound represented by Formula I were simultaneously added as shown in Table 2 to give emulsions A to O.

The emulsions A to O were each further ripened at 50° C. for 15 minutes, followed by addition of 4-hydroxy-6-methyl-1,3,3a,7-tetrazaindene and a-phenyl-5-mercaptotetrazole to effect stabilization.

TABLE 2

| | Spectral sensitizing dye 1 | | Compound of Formula I | |
|---|---|---|---|---|
| Emulsion | Amount* | Manner of addition | Kind | Amount* |
| A (X) | $5 \times 10^{-4}$ | a | — | — |
| B (X) | $5 \times 10^{-4}$ | b | — | — |
| C (X) | $5 \times 10^{-4}$ | a | I-4 | $3 \times 10^{-5}$ |
| D (Y) | $5 \times 10^{-4}$ | b | I-4 | $3 \times 10^{-5}$ |
| E (Y) | $5 \times 10^{-4}$ | b | I-5 | $3 \times 10^{-5}$ |
| F (Y) | $5 \times 10^{-4}$ | b | I-9 | $3 \times 10^{-5}$ |
| G (Y) | $5 \times 10^{-4}$ | b | I-14 | $3 \times 10^{-5}$ |
| H (Y) | $5 \times 10^{-4}$ | b | I-15 | $3 \times 10^{-5}$ |
| I (Y) | $5 \times 10^{-4}$ | b | I-18 | $3 \times 10^{-5}$ |
| J (Y) | $5 \times 10^{-4}$ | b | I-20 | $3 \times 10^{-5}$ |
| K (Y) | $5 \times 10^{-4}$ | b | I-21 | $3 \times 10^{-5}$ |
| L (Y) | $5 \times 10^{-4}$ | b | I-22 | $3 \times 10^{-5}$ |
| M (Y) | $5 \times 10^{-4}$ | b | I-23 | $3 \times 10^{-5}$ |
| N (Y) | $5 \times 10^{-4}$ | b | I-53 | $3 \times 10^{-5}$ |

TABLE 2-continued

| | Spectral sensitizing dye 1 | | Compound of Formula I | |
|---|---|---|---|---|
| Emulsion | Amount* | Manner of addition | Kind | Amount* |
| O (X) | $5 \times 10^{-4}$ | b | Cp. A | $1 \times 10^{-3}$ |

*indicated as mol per mol of AgX
Cp.: Comparative
X: Comparative Example,
Y: Present Invention
The manner a or b by which the spectral sensitizing dye is added is as follows:
a: A solution prepared by dissolving the spectral sensitizing dye in methyl alcohol in a concentration of 0.5% was added.
b: A solution prepared by dispersing the spectral sensitizing dye in water in a solid state was added.
Spectral sensitizing dye 1

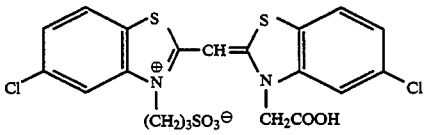

Comparative compound A

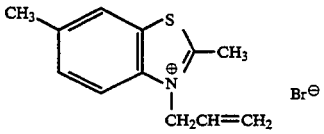

Next, the following yellow coupler 1 was dissolved in ethyl acetate and tricresyl phosphate and then emulsifyingly dispersed in an aqueous solution containing gelatin to obtain a dispersion. This dispersion and usual photographic additives such as a spreading agent and a hardening agent were added to each of the emulsions to prepare coating solutions. The coating solutions were each applied to a subbed triacetyl cellulose support by a conventional method, followed by drying. Thus, samples 101 to 115 were produced.

Yellow coupler 1

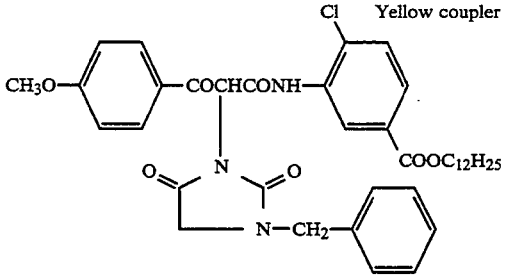

Samples 101 to 115 were each divided into two groups I and II. The samples of group I were subjected to wedge exposure by a conventional method, and immediately thereafter photographically processed according to the following processing steps. The samples of group II were subjected to wedge exposure like those of group I, which were thereafter left to stand in an environment of 23° C. and 55%RH for 7 days, and then processed in the same way.

The sensitivity of each sample was expressed as a reciprocal of the amount of exposure that gives an optical density of fog density +0.15, and indicated as a relative value assuming that of sample 101 as 100.

Results obtained are shown in Table 3.

| | - Processing steps - | | |
|---|---|---|---|
| Processing Step | Processing Time | Processing temperature | Amount of replenishing* |
| Color developing | 3 min 15 sec | 38 ± 0.3° C. | 780 ml |

-continued

| - Processing steps - | | | |
|---|---|---|---|
| Processing Step | Processing Time | Processing temperature | Amount of replenishing* |
| Bleaching | 45 sec | 38 ± 2.0° C. | 150 ml |
| Fixing | 1 min 30 sec | 38 ± 2.0° C. | 830 ml |
| Stabilizing | 60 sec | 38 ± 5.0° C. | 830 ml |
| Drying | 1 min | 55 ± 5.0° C. | — |

The amount of replenishing is indicated as a value per 1 $m^2$ of light-sensitive material.

The following color developing solution, bleaching solution, fixing solution, and replenishing solutions thereof were used.

| - Color developing solution and color developing replenishing solution - | | |
|---|---|---|
| | Developing solution | Replenish. solution |
| Water | 800 cc | 800 cc |
| Potassium carbonate | 30 g | 35 g |
| Sodium hydrogencarbonate | 2.5 g | 3.0 g |
| Potassium sulfite | 3.0 g | 5.0 g |
| Sodium bromide | 1.3 g | 0.4 g |
| Potassium iodide | 1.2 mg | — |
| Hydroxylamine sulfate | 2.5 g | 3.1 g |
| Sodium chloride | 0.6 g | — |
| 4-Amino-3-methyl-N-ethyl-N-(β-hydroxyethyl)aniline sulfate | 4.5 g | 6.3 g |
| Diethylenetriaminepentaacetic acid | 3.0 g | 3.0 g |
| Potassium hydroxide | 1.2 g | 2.0 g |

Made up to 1 liter by adding water, and adjusted to pH 10.06 and pH 10.18 in respect of the color developing solution and the replenishing solution, respectively, using potassium hydroxide or 20% sulfuric acid.

| - Bleaching solution and bleaching replenishing solution - | | |
|---|---|---|
| | Developing solution | Replenish. solution |
| Water | 700 cc | 700 cc |
| Ferric ammonium 1,3-diaminopropane-tetraacetate | 125 g | 175 g |
| Ethylenediaminetetraacetic acid | 2 g | 2 g |
| Sodium nitrate | 40 g | 50 g |
| Ammonium bromide | 150 g | 200 g |
| Glacial acetic acid | 40 g | 56 g |

Made up to 1 liter by adding water, and adjusted to pH 4.4 and pH 4.0 in respect of the bleaching solution and the replenishing solution, respectively, using ammonia water or glacial acetic acid.

| - Fixing solution and fixing replenishing solution - | | |
|---|---|---|
| | Developing solution | Replenish. solution |
| Water | 800 cc | 800 cc |
| Ammonium thiocyanate | 120 g | 150 g |
| Ammonium thiosulfate | 150 g | 180 g |
| Sodium sulfite | 15 g | 20 g |
| Ethylenediaminetetraacetic acid | 2 g | 2 g |

Adjusted to pH 6.2 and pH 6.5 in respect of the fixing solution and the replenishing solution, respectively, using ammonia water or glacial acetic acid, and thereafter made up to 1 liter by adding water.

| - Stabilizing solution and stabilizing replenishing solution - | |
|---|---|
| Water | 900 cc |
| 10 mol Ethylene oxide addition product of p-octylphenol | 2.0 g |
| Dimethylol urea | 0.5 g |
| Hexamethylenetetramine | 0.2 g |
| 1,2-Benzoisothiazolin-3-one | 0.1 g |
| Siloxane (L-77, available from UCC) | 0.1 g |
| Ammonia water | 0.5 cc |

Made up to 1 liter by adding water, and thereafter adjusted to pH 8.5 using ammonia water or 50% sulfuric acid.

TABLE 3

| Sample No. | Emulsion used | Sensitivity Sample I | Sensitivity Sample II | Fog |
|---|---|---|---|---|
| 101 (X) | A | 100 | 85 | 0.13 |
| 102 (X) | B | 105 | 87 | 0.12 |
| 103 (X) | C | 115 | 108 | 0.17 |
| 104 (Y) | D | 120 | 118 | 0.15 |
| 105 (Y) | E | 123 | 120 | 0.14 |
| 106 (Y) | F | 118 | 115 | 0.13 |
| 107 (Y) | G | 125 | 125 | 0.13 |
| 108 (Y) | H | 127 | 127 | 0.13 |
| 109 (Y) | I | 120 | 115 | 0.15 |
| 110 (Y) | J | 120 | 118 | 0.13 |
| 111 (Y) | K | 127 | 125 | 0.13 |
| 112 (Y) | L | 130 | 125 | 0.15 |
| 113 (Y) | M | 125 | 118 | 0.14 |
| 114 (Y) | N | 120 | 118 | 0.13 |
| 115 (X) | O | 105 | 100 | 0.13 |

X: Comparative Example,
Y: Present Invention

As is seen from Table 3, the samples of the present invention are improved in latent image stability while maintaining a high sensitivity. Also, the samples of the present invention are controlled to have a low fog density.

EXAMPLE 2

A multi-layer color light-sensitive material comprising a subbed triacetyl cellulose film support and provided thereon the layers composed as shown below was produced and was designated as sample 201. In the following, the amount of each additive is indicated as gram number per 1 $m^2$. The amounts of silver halide emulsions and colloidal silver are in terms of silver weight. Those of spectral sensitizing dyes contained in the same layer are each indicated as molar number per mol of silver.

| | |
|---|---|
| First layer: Anti-halation layer HC | |
| Black colloidal silver | 0.16 |
| Ultraviolet absorbent UV-1 | 0.30 |
| Gelatin | 1.70 |
| Second layer: Intermediate layer IL-1 | |
| Gelatin | 0.80 |
| Third layer: Low-speed red-sensitive layer RL | |
| Silver iodobromide emulsion (average grain size: 0.30 μm) | 0.40 |
| Spectral sensitizing dye S-1 | $1.2 \times 10^{-4}$ |
| Spectral sensitizing dye S-2 | $0.2 \times 10^{-4}$ |
| Spectral sensitizing dye S-3 | $2.0 \times 10^{-4}$ |
| Spectral sensitizing dye S-4 | $1.2 \times 10^{-4}$ |
| Cyan coupler C-1 | 0.33 |
| Colored cyan coupler CC-1 | 0.05 |
| High-boiling solvent Oil-1 | 0.30 |
| Gelatin | 0.55 |
| Fourth layer: Medium-speed red-sensitive layer RM | |
| Silver iodobromide emulsion | 0.48 |

-continued

| | |
|---|---|
| (average grain size: 0.40 μm) | |
| Spectral sensitizing dye S-1 | $1.5 \times 10^{-4}$ |
| Spectral sensitizing dye S-2 | $0.2 \times 10^{-4}$ |
| Spectral sensitizing dye S-3 | $2.5 \times 10^{-4}$ |
| Spectral sensitizing dye S-4 | $1.5 \times 10^{-4}$ |
| Cyan coupler C-1 | 0.30 |
| Colored cyan coupler CC-1 | 0.05 |
| High-boiling solvent Oil-1 | 0.40 |
| Gelatin | 0.60 |
| Fifth layer: High-speed red-sensitive layer RH | |
| Silver iodobromide emulsion | 0.66 |
| (average grain size: 0.51 μm) | |
| Spectral sensitizing dye S-1 | $1.0 \times 10^{-4}$ |
| Spectral sensitizing dye S-2 | $0.2 \times 10^{-4}$ |
| Spectral sensitizing dye S-3 | $1.7 \times 10^{-4}$ |
| Spectral sensitizing dye S-4 | $1.0 \times 10^{-5}$ |
| Cyan coupler C-2 | 0.10 |
| Colored cyan coupler CC-1 | 0.01 |
| DIR compound D-1 | 0.02 |
| High-boiling solvent Oil-1 | 0.15 |
| Gelatin | 0.53 |
| Sixth layer: Intermediate layer IL-2 | |
| Gelatin | 0.80 |
| Seventh layer: Low-speed green-sensitive layer GL | |
| Silver iodobromide emulsion | 0.60 |
| (average grain size: 0.40 μm) | |
| Silver iodobromide emulsion | 0.40 |
| (average grain size: 0.30 μm) | |
| Spectral sensitizing dye S-1 | $0.6 \times 10^{-4}$ |
| Spectral sensitizing dye S-5 | $5.1 \times 10^{-4}$ |
| Magenta coupler M-1 | 0.55 |
| Colored magenta coupler CM-1 | 0.17 |
| DIR compound D-2 | 0.03 |
| High-boiling solvent Oil-2 | 0.70 |
| Gelatin | 1.56 |
| Eighth layer: High-speed green-sensitive layer GH | |
| Silver iodobromide emulsion | 0.60 |
| (average grain size: 0.88 μm) | |
| Spectral sensitizing dye S-6 | $1.5 \times 10^{-4}$ |
| Spectral sensitizing dye S-7 | $1.5 \times 10^{-4}$ |
| Spectral sensitizing dye S-8 | $1.5 \times 10^{-4}$ |
| Magenta coupler M-1 | 0.06 |
| Magenta coupler M-2 | 0.02 |
| Colored magenta coupler CM-2 | 0.02 |
| DIR compound D-3 | 0.002 |
| High-boiling solvent Oil-2 | 0.15 |
| Gelatin | 0.45 |
| Ninth layer: Yellow filter layer YC | |
| Yellow colloidal silver | 0.08 |
| Formalin scavenger HS-1 | 0.20 |
| Anti-color-stain agent HS-2 | 0.15 |

-continued

| | |
|---|---|
| High-boiling solvent Oil-2 | 0.19 |
| Gelatin | 0.80 |
| Tenth layer: Low-speed blue-sensitive layer BL | |
| Silver iodobromide emulsion | 0.18 |
| (average grain size: 0.40 μm) | |
| Silver iodobromide emulsion | 0.35 |
| (average grain size: 0.30 μm) | |
| Spectral sensitizing dye S-9 | $5.1 \times 10^{-4}$ |
| Spectral sensitizing dye S-10 | $2.0 \times 10^{-4}$ |
| Yellow coupler Y-1 | 0.58 |
| Yellow coupler Y-2 | 0.30 |
| High-boiling solvent Oil-2 | 0.15 |
| Gelatin | 1.20 |
| Eleventh layer: High-speed blue-sensitive layer BH | |
| Yellow coupler Y-1 | 0.10 |
| High-boiling solvent Oil-2 | 0.04 |
| Gelatin | 0.50 |
| Twelfth layer: First protective layer PRO-1 | |
| Silver iodobromide emulsion | 0.30 |
| (average grain size: 0.07 μm) | |
| Ultraviolet absorbent UV-1 | 0.07 |
| Ultraviolet absorbent UV-2 | 0.10 |
| High-boiling solvent Oil-2 | 0.07 |
| High-boiling solvent Oil-3 | 0.07 |
| Formalin scavenger HS-1 | 0.25 |
| Gelatin | 0.80 |
| Thirteenth layer: Second protective layer PRO-2 | |
| Alkali-soluble matting agent | 0.13 |
| (average particle diameter: 2 μm) | |
| Polymethyl methacrylate | 0.02 |
| (average particle diameter: 3 μm) | |
| Gelatin | 0.50 |

In addition to the foregoing composition, coating aid Su-1, dispersion aid Su-2, hardening agents H-1 and H-2, and dyes AI-1 and AI-2 were appropriately added.

Structures of the compounds used in the preparation of the above sample are shown below.

Oil-1: Dioctyl phthalate
Oil-2: Tricresyl phosphate
Oil-3: Dibutyl phthalate
Su-1: Sodium dioctyl sulfosuccinate
Su-2: Sodium tri-i-propylnaphthalene sulfonate
HS-: 1-(3-Sulfophenyl)-3-methyl-5-imino-2-pyrazolidone
HS-2: 2-sec-Octadecyl-5-methylhydroquinone
H-1: 2,4-Dichloro-6-hydroxy-s-triazine sadium salt
H-2: Bis(vinylsulfonylmethyl)ether

C-1

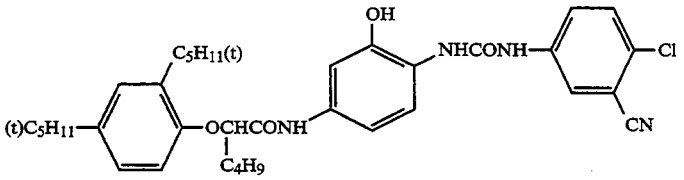

C-2

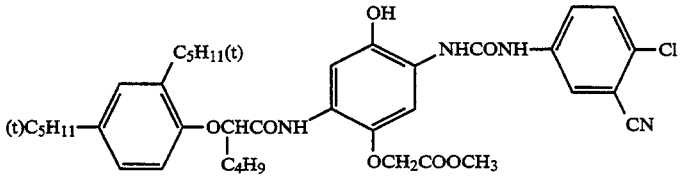

-continued
M-1
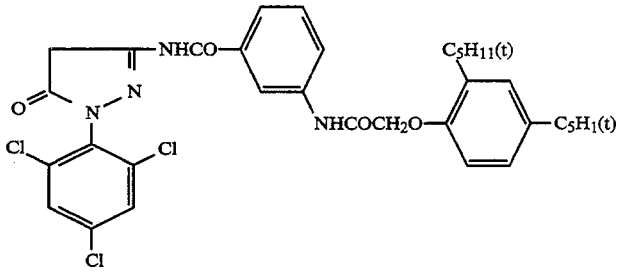
M-2
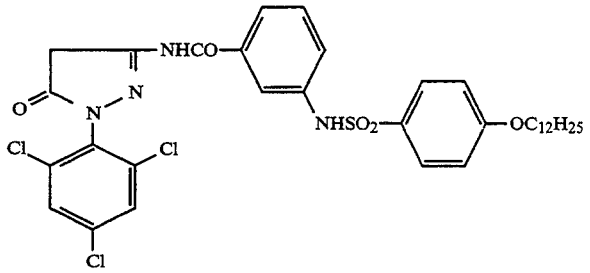
Y-1
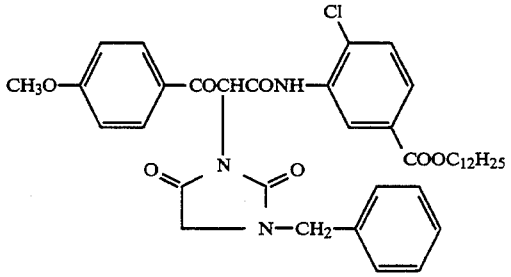
Y-2
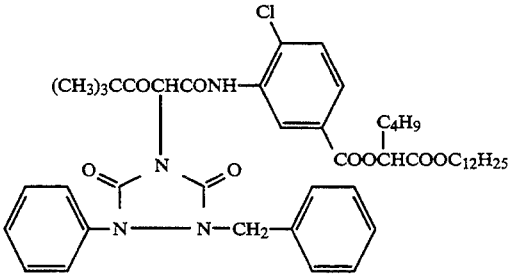
CC-1
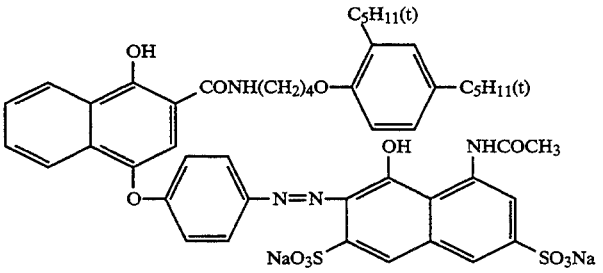
CM-1
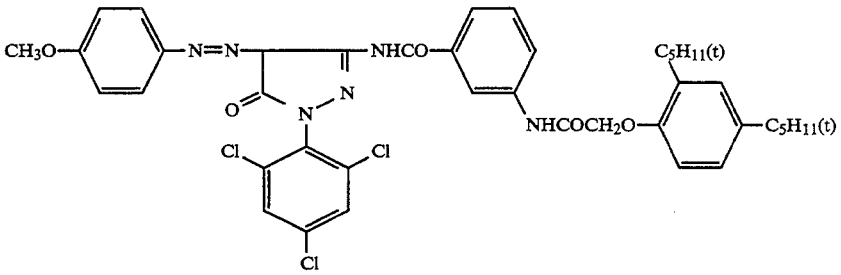

-continued
CM-2
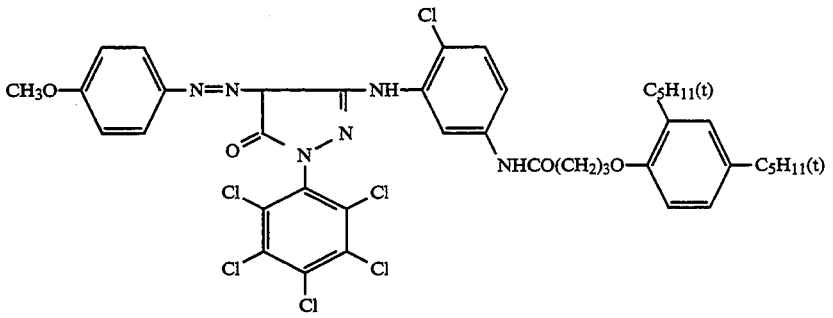
D-1
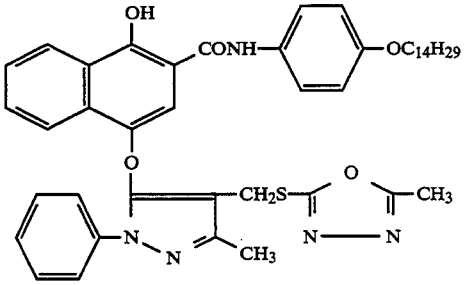
D-2
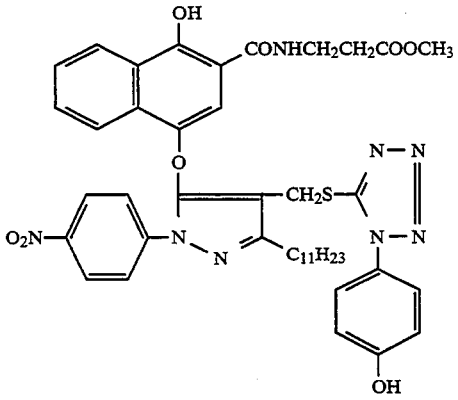
D-3
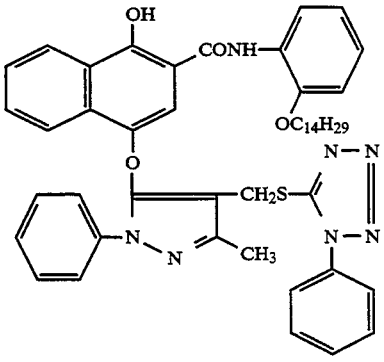
UV-1
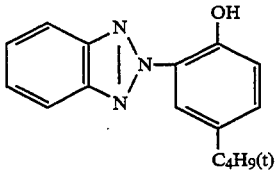
UV-2
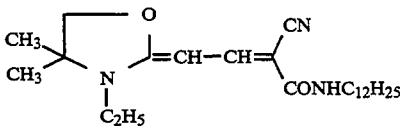
S-1
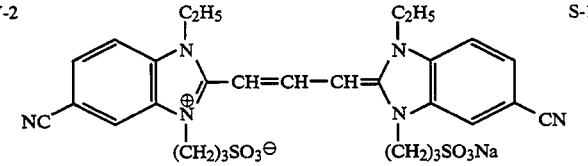
S-2
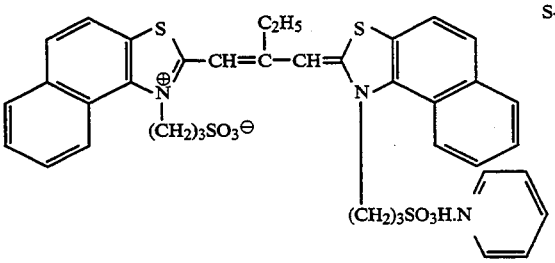
S-3
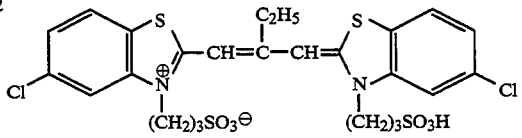
S-4
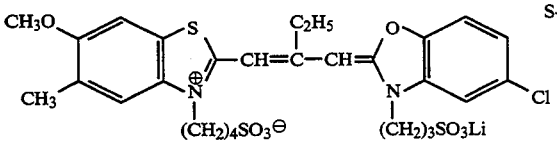
S-5
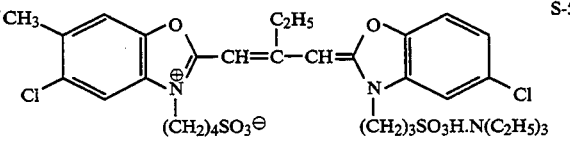

-continued

S-6

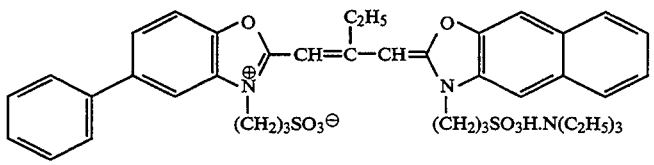

S-7

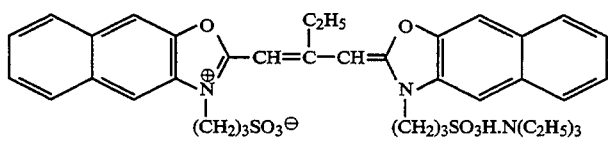

S-8

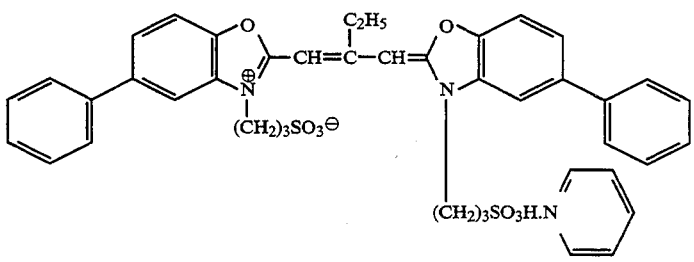

S-9

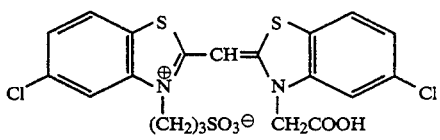

S-10

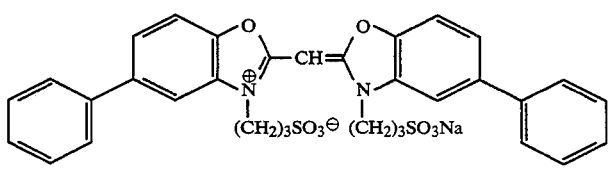

AI-1

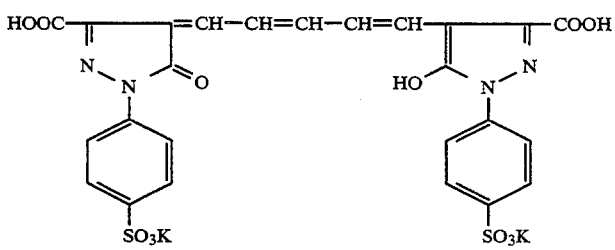

AI-2

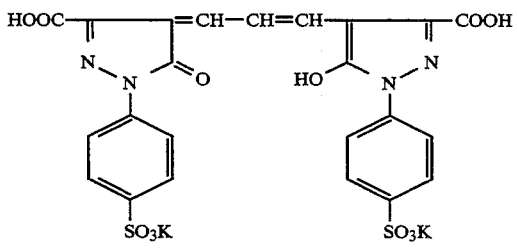

Meanwhile, to the eleventh layer of sample 201, the same silver halide emulsions A to O as those prepared in Example 1 were each added in an amount of 0.45 g per 1 $m^2$ in terms of silver. Thus, samples 301 to 315 were produced. The samples were each divided into two groups I and II like those in Example 1. The samples of group I were subjected to wedge exposure by a conventional method, and immediately thereafter photographically processed in the same manner as in Example 1. The samples of group II were subjected to wedge exposure like those of group I, which were thereafter left to stand in an environment of 23° C. and 55%RH for 7 days, and then processed in the same way.

The sensitivity of each sample was expressed as a reciprocal of the amount of exposure in which the blue color density gives an optical density of fog density +0.15.

As a result, like the results in Example 1, samples 304 to 314 (corresponding to samples 104 to 114) making use of the silver halide emulsion of the present invention showed an improvement in latent image stability compared with comparative samples 301 to 303 and 315 (corresponding to samples 101 to 113 and 115). At the same time, the samples of the present invention were found to have a high sensitivity and have been controlled to have a low fog density.

As described above, the present invention has made it possible to provide a silver halide photographic emulsion having a high sensitivity, a low fog and a superior latent image stability.

What is claimed is:

1. A silver halide photographic emulsion comprising a substantially water-insoluble spectral sensitizing dye and a compound represented by the following formula I, wherein the sensitizing dye is dispersed in an aqueous solution substantially free from an organic solvent and the thus-dispersed dye is introduced into the silver halide emulsion, Formula I

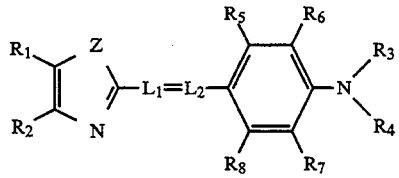

wherein $R_1$, $R_2$, $R_3$ and $R_4$ each represent a hydrogen atom, an alkyl group, an alkenyl group, an alkynyl group, an aryl group or a heterocyclic group; $R_5$, $R_6$, $R_7$ and $R_8$ each represent a substituent; $L_1$ and $L_2$ each represent a methine group; Z represents an oxygen atom, a sulfur atom, a selenium atom, a tellurium atom, a —C($R_9$)($R_{10}$)— group or an —N($R_9$)— group, where $R_9$ and $R_{10}$ each represent a hydrogen atom, an alkyl group, an alkenyl group, an alkynyl group, an aryl group or a heterocyclic group; and $R_1$ and $R_2$, $R_3$ and $R_4$, and $R_9$ and $R_{10}$ may combine to form a ring.

2. The photographic emulsion of claim 1, wherein the sensitizing dye has a solubility of not more than $8\times10^{-2}$ mol/l.

3. The photographic emulsion of claim 1, wherein the sensitizing dye is represented by the following formula II Formula II

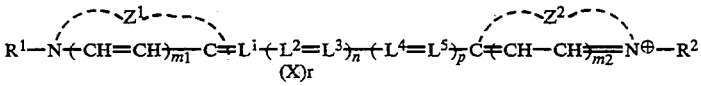

wherein $Z^1$ and $Z^2$ each represent a group of atoms necessary to form a nitrogen-containing heterocyclic 5- or 6-membered ring; $L^1$, $L^2$, $L^3$ and $L^4$ each represent a methine group; $R^1$ and $R^2$ each represent an alkyl group; X is a counter ion; r is the number necessary to neutralize the charge of the dye moiety; $m_1$ and $m_2$ are each an integer of 0 or 1; n and p are each an integer of 0 to 2.

4. The silver halide photographic emulsion of claim 1, wherein the compound of formula I is contained in an amount of $2\times10^{-7}$ to $1\times10^{-2}$ mol per mol of Ag.

* * * * *